US007004788B2

(12) United States Patent
Montena

(10) Patent No.: US 7,004,788 B2
(45) Date of Patent: Feb. 28, 2006

(54) ENVIRONMENTALLY PROTECTED AND TAMPER RESISTANT CATV DROP CONNECTOR

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/946,830

(22) Filed: Sep. 22, 2004

(65) Prior Publication Data

US 2005/0042919 A1 Feb. 24, 2005

Related U.S. Application Data

(62) Division of application No. 10/623,730, filed on Jul. 21, 2003.

(51) Int. Cl.
*H01R 9/05* (2006.01)

(52) U.S. Cl. ..... 439/578

(58) Field of Classification Search ..... 439/583, 439/578, 131, 650, 651, 652, 653, 654, 535
See application file for complete search history.

(56) References Cited

U.S. PATENT DOCUMENTS 4,339,166 A 7/1982 Dayton
4,515,427 A 5/1985 Smit
4,668,043 A 5/1987 Saba et al.
4,684,201 A 8/1987 Hutter
4,806,116 A 2/1989 Ackerman
5,007,861 A 4/1991 Stirling
5,800,211 A 9/1998 Stabile et al.
6,153,830 A * 11/2000 Montena ..... 439/578
6,210,222 B1 4/2001 Langham et al.
6,261,126 B1 7/2001 Stirling

* cited by examiner

*Primary Examiner*—Briggitte R. Hammond
(74) *Attorney, Agent, or Firm*—Wall Marjama & Bilinski LLP

(57) ABSTRACT

In addition to the single molded part incorporating features of the conventional nut, sealing member and body, the connector includes a post and a hollow compression sealing ring. The post includes an integrally formed stem and flange portions, with the compression ring axially movable upon the body and including a tapered surface which applies a radially inward force to the body, compressing the cable and providing tight frictional engagement of the connector and cable. When in its fully installed position, the axial length of the ring is sufficient to entirely enclose the unitary body and nut, preferably having an interference fit with the outer surface of the nut portion, thus locking and sealing the connector threads to the equipment port. The compression ring is preferably of metal to shield the internal plastic parts of the connector from UV rays.

4 Claims, 9 Drawing Sheets

ENVIRONMENTALLY PROTECTED AND TAMPER RESISTANT CATV DROP CONNECTOR

This application is a divisional of U.S. application Ser. No. 10/623,730, filed Jul. 21, 2003, which is incorporated herein by reference.

FIELD OF THE INVENTION

Background of the Invention

Threaded connectors mounted to end portions of coaxial cables are employed in the CATV industry in both indoor and outdoor applications. In either case, it is desirable to protect the end of the cable and its junction with the equipment to which it is attached from environmental hazards such as moisture and dirt. Connectors used on drop cables in outdoor installations are commonly exposed to harsher environmental conditions and, in addition, are subject to physical tampering and vandalism as, for example, in actual or attempted theft of services. As the industry moves toward "permanent" installations with addressable taps, with rising installation and service costs, there is clearly a need for connectors which maintain their integrity and reliability over long periods, as well as having means for defeating or discouraging physical interference by unauthorized persons. Furthermore, it is always desirable, of course, to produce virtually any article of manufacture at lower cost without sacrificing standards of operation and quality.

It is an object of the present invention to provide a connector for mounting to a coaxial cable which has improved environmental protection features, particularly over extended periods of time.

Another object is to provide a CATV connector having enhanced features suitable for outdoor installation.

A further object is to provide a threaded connector for use in CATV applications having built-in tamper resistant features.

Still another object is to provide a CATV coaxial cable connector which is generally less expensive to produce than prior art connectors used in the same applications while still providing equal or better performance, reliability and durability.

A still further object is to provide a connector for mounting to a terminal end of a coaxial cable which has fewer parts than conventional connectors of this type.

Yet another object is to provide a novel and improved method of mounting a connector to a coaxial cable and for installing the connector on a compatible equipment port.

Other objects will in part be obvious and will in part appear hereinafter.

SUMMARY OF THE INVENTION

In accordance with the foregoing objects, the invention contemplates a connector in which the threaded member incorporates a high strength plastic thread which is slippery, i.e., low friction, and flexible and interferes with the threads of the port to which the connector is engaged. This eliminates the need for additional rubber sealing boots, messy silicone grease or RTV, or hard to turn dry pipe dopes. The plastic "nut" is molded as an integral part of the portion of the connector which seals the cable interface, thereby eliminating the usual joint between the nut and the connector body. This joint is typically sealed with an O-ring to prevent ingress of moisture; by eliminating the joint, there is no need for the O-ring or other sealing means and no possibility of moisture entry. By combining the conventional turned metal nut, the O-ring and molded plastic body in a single, injection molded part, the connector of the present invention is significantly reduced in cost.

In addition to the single molded part incorporating features of the conventional nut, sealing member and body, the connector includes a post and a hollow, compression sealing ring. The post includes the usual, integrally formed stem and flange portions; however, the compression ring is somewhat different than the comparable part in prior connectors. The ring is axially movable upon the body and includes a tapered surface which applies a radially inward force to the body, compressing the cable and providing tight frictional engagement of the connector and cable. In addition, when in its fully installed position, the axial length of the ring is sufficient to entirely enclose the unitary body and nut, preferably having an interference fit with the outer surface of the nut portion. This locks and seals the connector threads to the equipment port. Also, the compression ring is preferably of metal in order to shield the internal plastic parts of the connector from UV rays which would otherwise chemically deteriorate such parts over the extended time of expected service of the connector.

The method of installation of the connector differs from that of a standard F connector in that the connector is threaded to the equipment port prior to insertion of the cable end into the connector. With the ring in the uncompressed position, the connector nut portion is tightened to the port using a special wrench similar to a trap tool. The cable end is inserted into the connector with markings on the outer surface of the cable indicating to the installer the proper extent of advancement of the cable. The compression ring is then moved to the fully compressed position with the aforementioned interference fit with the nut portion. After installation, the connector can be removed only by cutting the cable behind the connector and using pliers to twist the connector off the port.

The foregoing and other features of construction and operation of the connector of the invention and its method of installation will be more fully understood and fully appreciated from the follow detailed disclosure, taken in conjunction with the accompanying drawings.

DETAILED DESCRIPTION OF THE PREFERRED EMBODIMENT(S)

Figure 1:
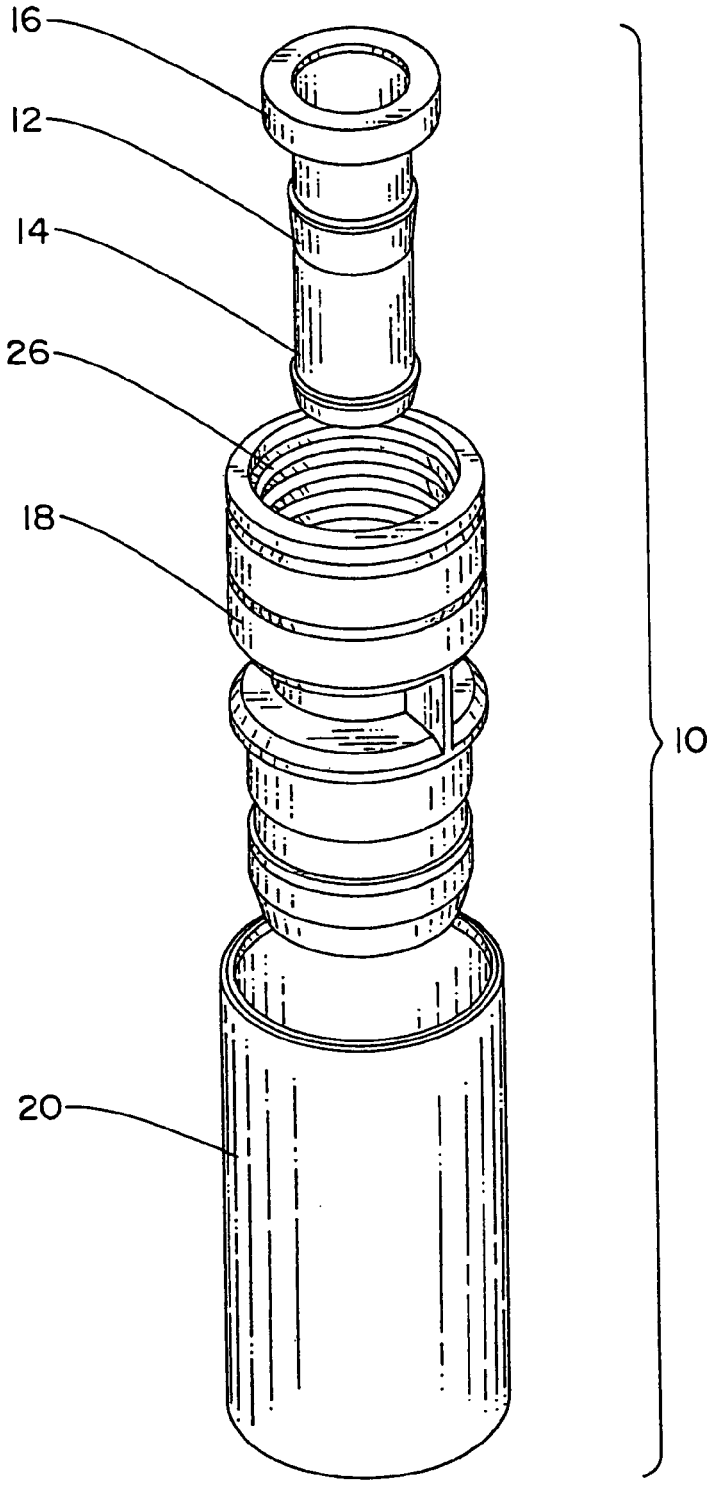
FIG. 1 is an exploded, perspective view showing the individual parts of the connector of the invention in a preferred embodiment.

Referring now the drawings, the elements of the connector, generally denoted by reference numeral 10, are shown in FIG. 1 in exploded perspective as comprising post 12, including stem 14 and flange 16 portions, body 18 and compression ring 20. Post 12 is a metal part, substantially identical to the corresponding part of prior art connectors. Body 18 is a unitary, molded part from a suitable plastic, differing in a number of important respects from the body portions of conventional connectors, as discussed later herein in more detail. Compression ring 20 is preferably of metal and has an axial length substantially equal to that of body 18, another distinction from the usual, much shorter ring. The outer surface of ring 20 is cylindrical while the inner surface, as will be seen, is cylindrical for a portion of the ring's length and tapered for another portion. As seen in FIG. 3B, connector 10 may comprise a post 12 and ring 20 that is roll formed or drawn.

Figure 2:
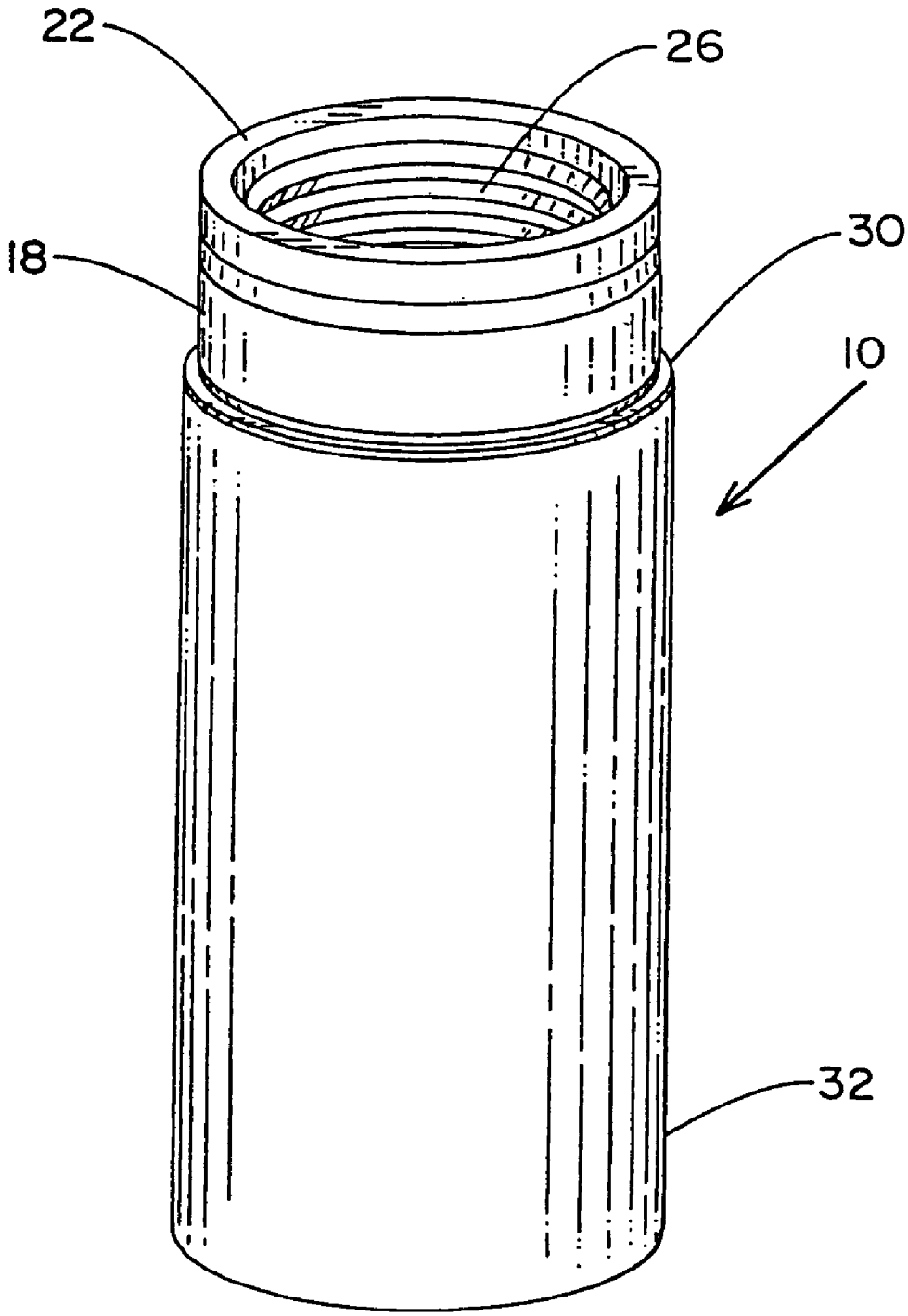
FIG. 2 is a perspective view of the connector of FIG. 1, with the parts assembled, in its initial, uncompressed condition.
Figure 3A:
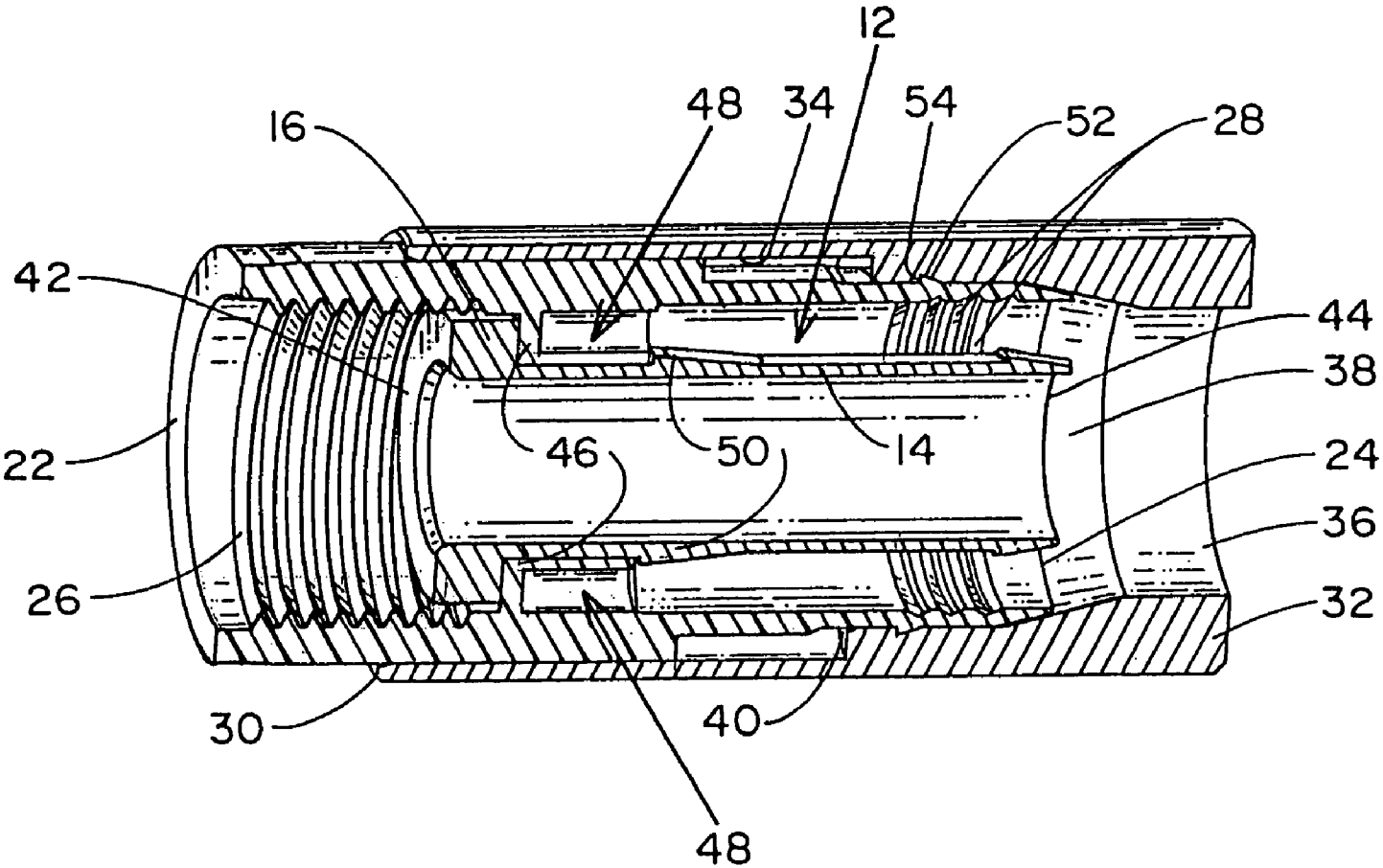
FIG. 3A is a perspective view of the connector in section, revealing the internal structure and physical relationship of the parts.
Figure 3B:
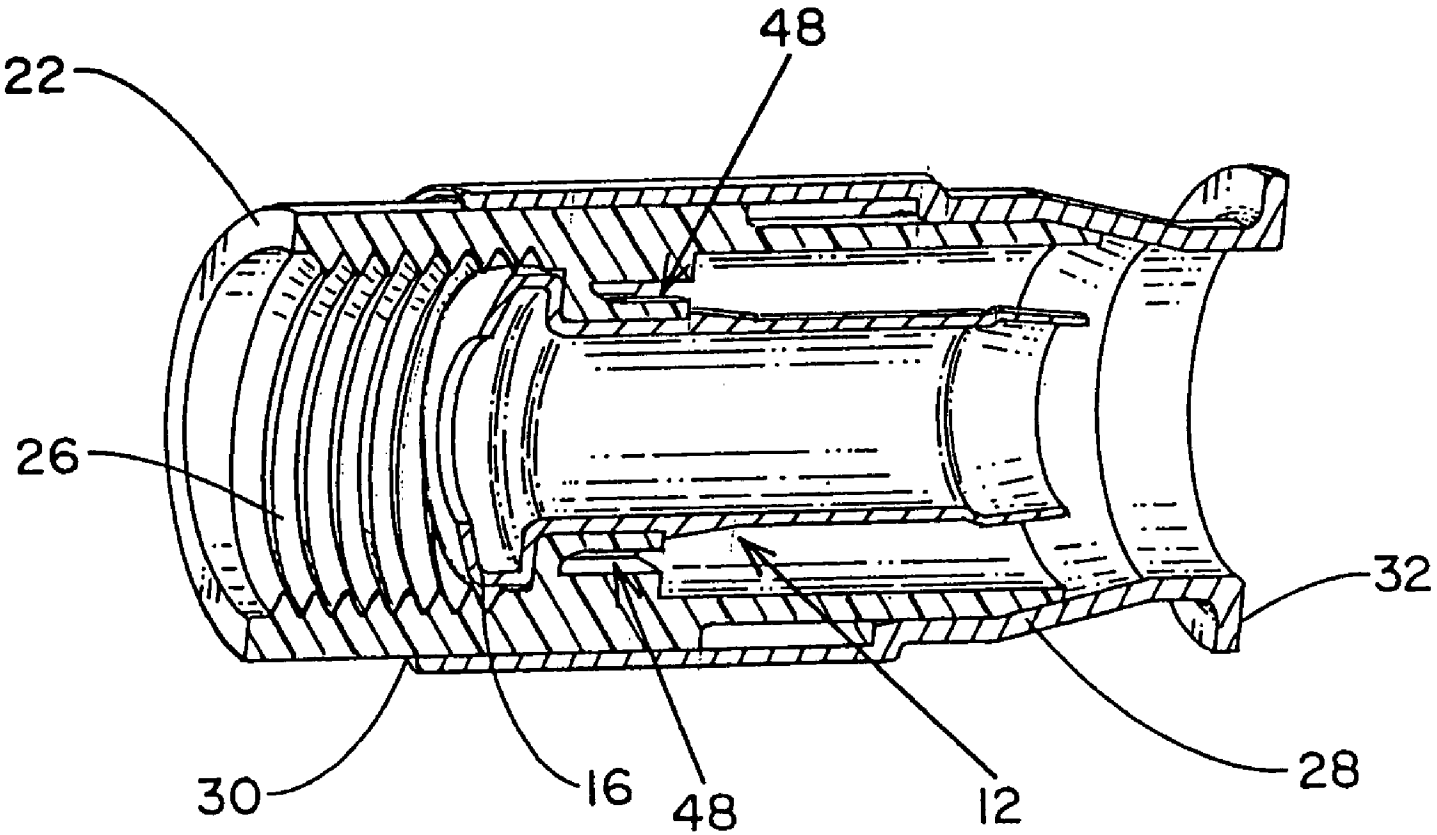
FIG. 3B is a perspective view of an alternative embodiment connector in section, revealing the internal structure and physical relationship of the parts.

In FIGS. 2, 3A and 3B, the parts are shown in assembled relation, prior to installation of the connector on a port. Body 18 is hollow, with a through bore, extending between opposite ends 22 and 24. Molded threads 26 extend from end 22 for a portion of the body's length, and indentations 28 are formed in the inner surface of the bore, near end 24. Ring 20 extends between ends 30 and 32, having an inner, cylindrical surface portions 34 and 36 and tapered portion 38 extending between stepped shoulder 40 and cylindrical portion 36. Post 12 extends between end 42, a planar surface of flange 16, and end 44, having a continuous, cylindrical, inner surface. The parts are assembled by inserting end 44 of post 12 through end 22 of body 18 until the surface at the juncture of stem 14 and flange 16 contacts structure 46 of body 18 extending into the interior thereof and having open recesses 48, the purpose of which is discussed later. Structure 46 is received between flange 16 and shoulder 50 on the outer surface of stem 14, thereby retaining the post and body in assembled relation. Ring 20 is retained in assembly with body 18 by engagement of opposing shoulders 52 and 54 on the inner and outer surfaces of the ring and body, respectively, preferably via an interference fit with body 18.

Figure 4A:
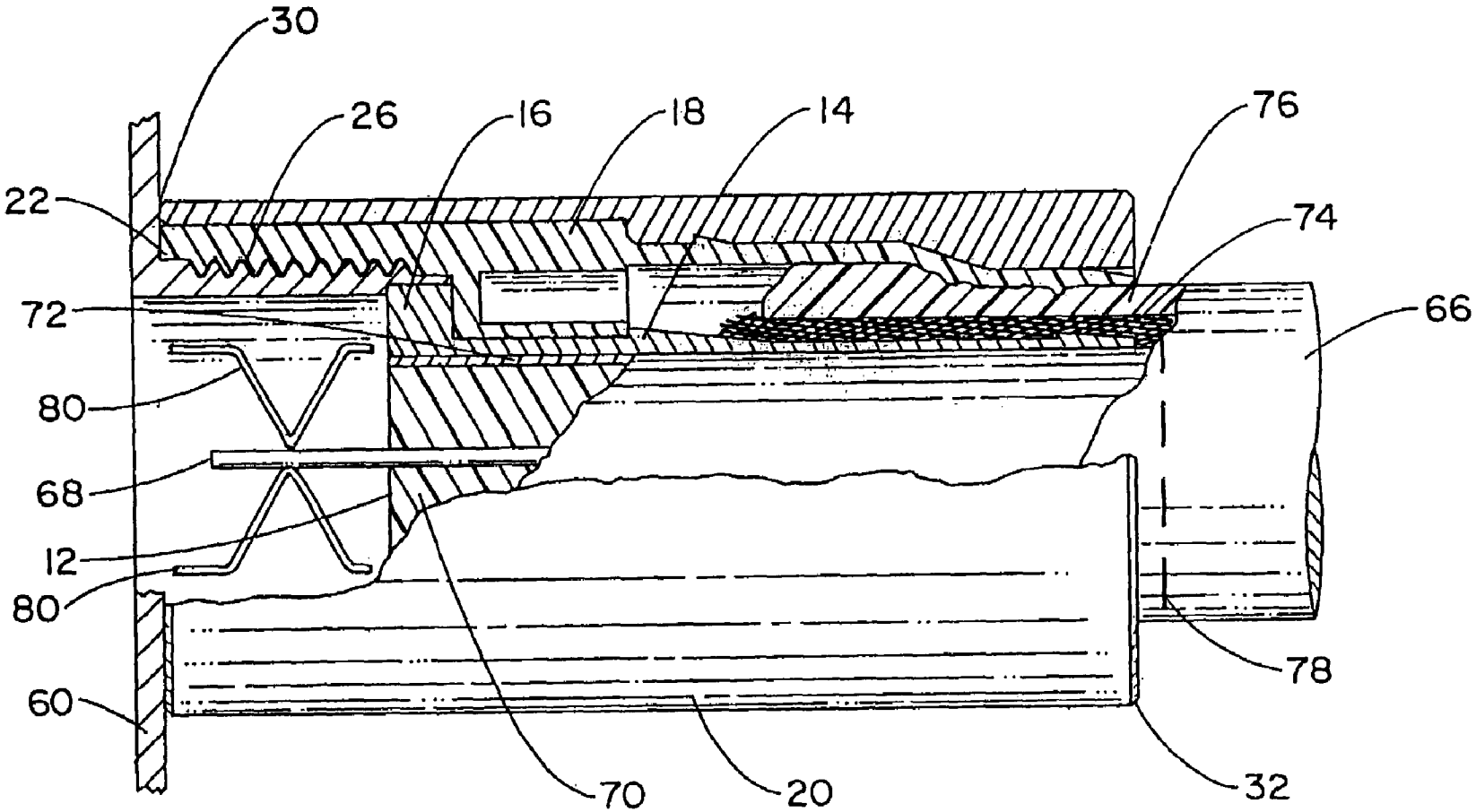
FIG. 4A is a fragmentary, side elevational view, in section, of the connector and portions of the coaxial cable and a port of equipment to which it is attached.
Figure 4B:
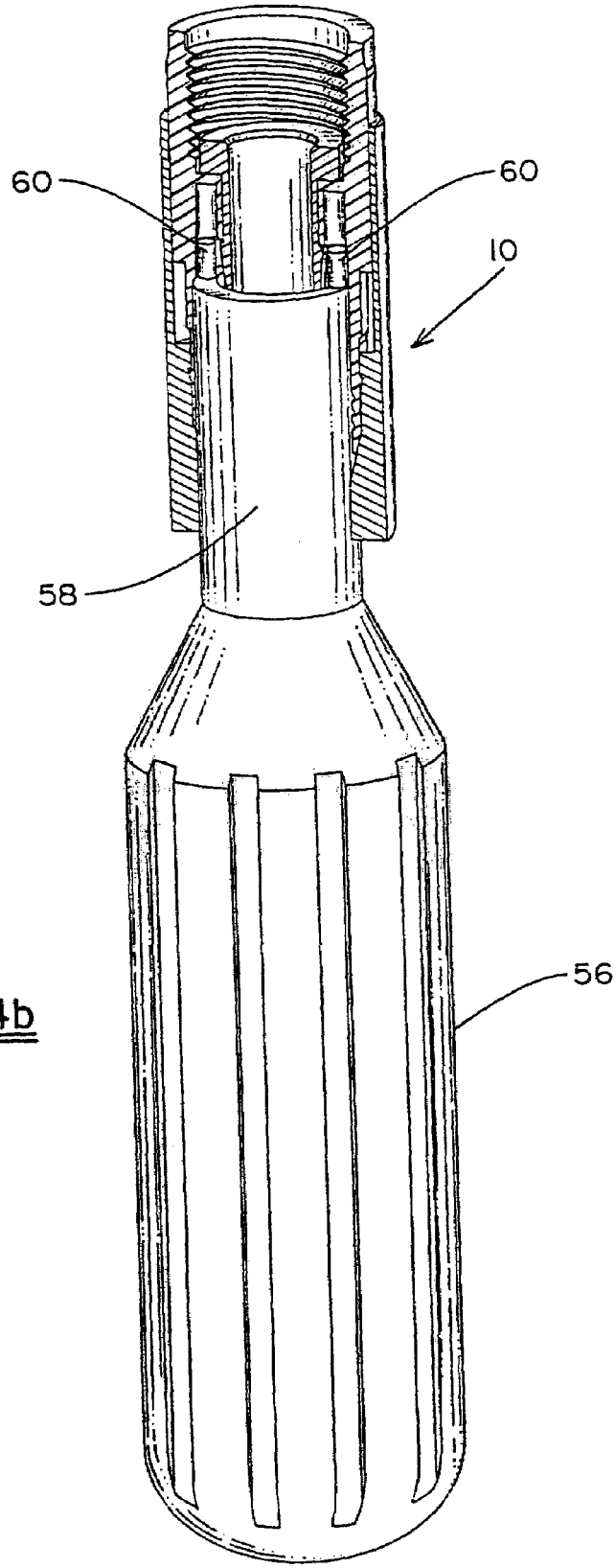
FIG. 4B is a perspective view, with portions broken away, of an installation tool engaging the connector.
Figure 4C:
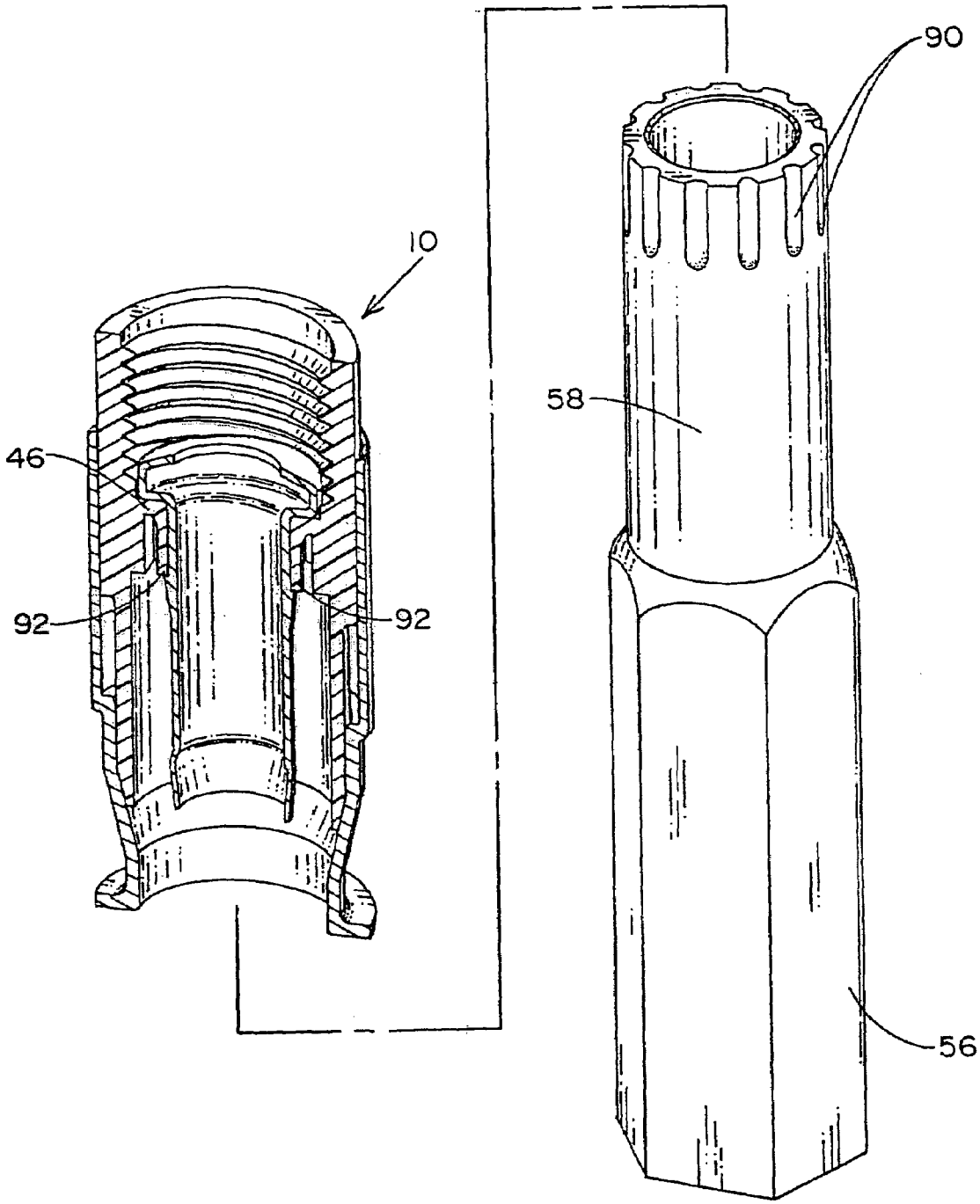
FIG. 4C is a perspective view, with portions broken away, of an installation tool engaging an alternative embedment of the connector.

Connector 10 is shown in FIG. 4A as it is mounted to a piece of equipment having an externally threaded shaft for engagement with threads 26 of body 18. A tool in the nature of a wrench 56 includes a hollow, cylindrical portion 58 sized to fit into the annular space between the outside of post 12 and the inside of body 18. As seen if FIG. 4B, A pair of pins 60 extend into recesses 48 of body structure 46 (FIG. 3) to rotationally engage wrench 56 with body 18. Of course, means other than pins and recesses may be used to provide rotational engagement of the tool and body structure. As seen in FIG. 4C, wrench 56 may optionally contain a series of splines 90 adapted to engage complimentary protuberances 92 on structure 46. Manual rotation of wrench 56 brings body 18 into tightly threaded engagement with shaft 62 of equipment 64, as seen in FIG. 4A. As previously mentioned, threads 26 are formed in the injection molding of body 18 of high strength plastic and are therefore lower in surface friction and more flexible than comparable, machined metal threads such as those of shaft 62. The molded threads are designed to interfere with the metal threads, creating a thread seal in much the same way as common pipe threads.

Wrench 56 is then removed and the end of coaxial cable 66 is inserted into the connector. Cable 66, which includes central conductor 68, inner dielectric layer 70, conducting layer 72, woven mesh shielding layer 74 and outer dielectric layer 76, has been prepared in standard manner by removing specified lengths of the various layers of the cable. As the cable is advanced, stem 14 of post 12 is forced between conducting layer 72 and shielding layer 74. A visible mark 78 is placed on the outer surface of cable 66 to indicate to the installer the proper extent of advancement of the cable into the connector, i.e., when the end surfaces of layers 70 and 72 are substantially flush with the end surface of flange 16. Upon full advancement of cable 66 to the position of FIG. 4A, central conductor 68 is engaged by contacts 80, and the end of shaft, thereby electrically connecting the cable to the equipment.

Figure 5:
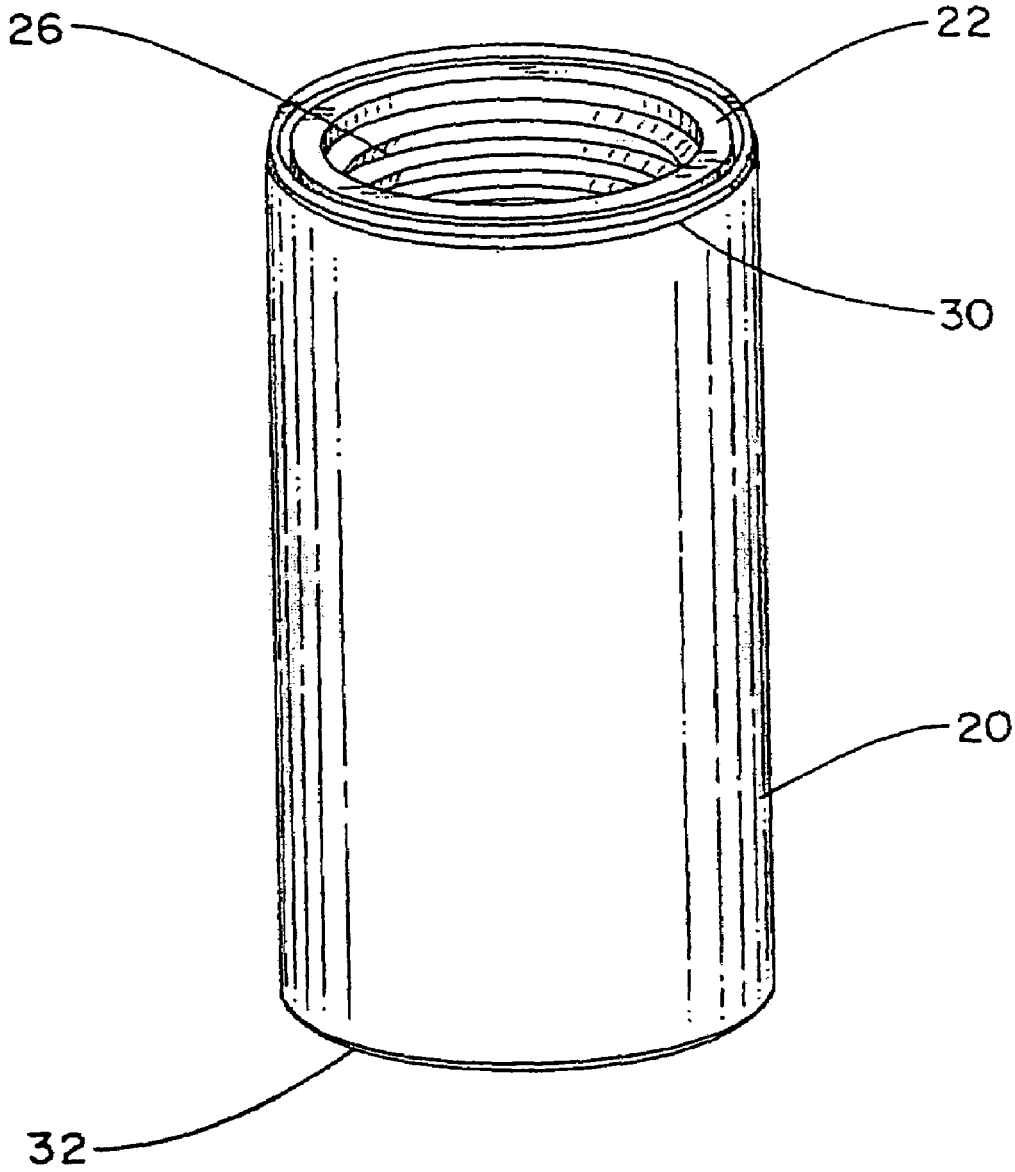
FIG. 5 is a perspective view of the connector in its fully installed (compressed) condition.
Figure 6:
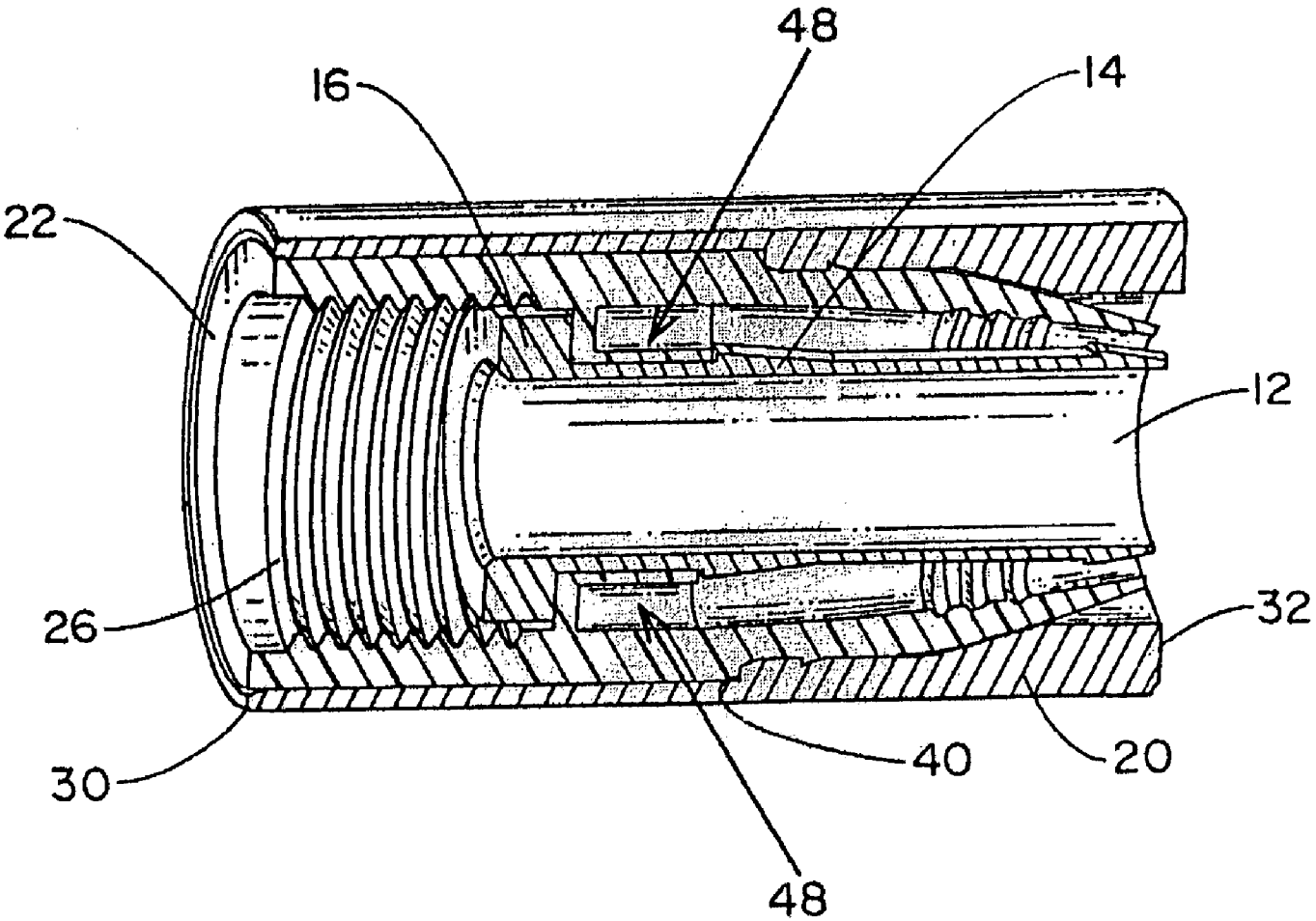
FIG. 6 is a perspective view of the connector in section, showing the internal parts in their fully installed condition together with a portion of a coaxial cable to which the connector is joined.

After mounting the connector 10 to the equipment and the cable to the connector, ring 20 is axially moved, with the aid of an appropriate compression tool, into fully covering relation to body 18, as seen in FIGS. 5 and 6. Ring 20 is advanced until internal shoulder 40 thereof contacts internal shoulder 82 of body 18, at which point both ends 30 and 32 of ring 20 will be substantially flush with ends 22 and 24, respectively, of body 18. Thus, metal ring 20 provides an essentially complete shield against UV rays for plastic body 18. It is also preferred that the outer diameter of body 18 in the area surrounding threads 26 be slightly larger than the opposing portion of the inner diameter of ring 20, thereby providing an interference fit and virtually preventing non-destructive removal of ring 20 after full installation. Advancement of ring 20 also compresses threads 26 inwardly, providing for further sealing of connector 10 to a piece of equipment.

From the foregoing it will be seen that the connector of the invention and the method of its installation to connect a coaxial cable to a piece of equipment provide a host of advantages, among which are economy of fabrication and installation, longevity of useful service, discouraging or defeating theft of services or other tampering, and protection from the elements.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A body member for use in a connector which mounts a coaxial cable having an outer dielectric layer to a piece of equipment by threaded engagement of internal threads on said body member with external, metal threads of known pitch and diameter on a shaft surrounding a port on said equipment, said body member comprising:

a) a one-piece plastic molding having an outer surface, first and second opposite ends, a central axis and a through, axial bore defining an inner surface;

b) internal, plastic threads molded into said inner surface and extending axially thereof for a first distance from said first opposite end; and c) said plastic threads having a pitch and diameter such that said plastic threads mate with said metal threads by interference fit, whereby engagement of said plastic and metal threads forms a thread seal d) said second opposite end being dimensioned and configured to receive and grasp the outer dielectric layer of the coaxial cable.

2. The body member of claim 1 wherein said first distance is less than one-half the axial length of said body member.

3. The body member of claim 1 and further including structure on said inner surface for rotational engagement by a tool to impart rotation to said body member for engagement of said internal threads with said external threads.

4. The body member for use in a connector which mounts a coaxial cable to a piece of equipment by threaded engagement of internal threads on said body member with external, metal threads of known pitch and diameter on a shaft surrounding a port on said equipment, said body member comprising:

a) a one-piece plastic molding having an outer surface, opposite ends, a central axis and a through, axial bore defining an inner surface;

b) internal, plastic threads molded into said inner surface and extending axially thereof for a first distance from one of said opposite ends;

c) said plastic threads having a pitch and diameter such that said plastic threads mate with said metal threads by interference fit, whereby engagement of said plastic and metal threads forms a thread seal; and d) at least two open recesses on said inner surface for rotational engagement by a tool to impart rotation to said body member for engagement of said internal threads with said external threads.

* * * * *

UNITED STATES PATENT AND TRADEMARK OFFICE

CERTIFICATE OF CORRECTION

PATENT NO. : 7,004,788 B2
DATED : February 28, 2006
INVENTOR(S) : Noah Montena

It is certified that error appears in the above-identified patent and that said Letters Patent is hereby corrected as shown below:

Column 2,
Line 66, replace “embedment” with -- embodiment --.

Column 3,
Line 55, replace “if” with -- in --.

Signed and Sealed this

Second Day of May, 2006

JON W. DUDAS
*Director of the United States Patent and Trademark Office*